US012180606B2

(12) United States Patent
Seki et al.

(10) Patent No.: US 12,180,606 B2
(45) Date of Patent: Dec. 31, 2024

(54) PLATING APPARATUS

(71) Applicant: EBARA CORPORATION, Tokyo (JP)

(72) Inventors: Masaya Seki, Tokyo (JP); Masaki Tomita, Tokyo (JP); Shao Hua Chang, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 600 days.

(21) Appl. No.: 17/617,135

(22) PCT Filed: Feb. 22, 2021

(86) PCT No.: PCT/JP2021/006564
§ 371 (c)(1),
(2) Date: Dec. 7, 2021

(87) PCT Pub. No.: WO2022/176186
PCT Pub. Date: Aug. 25, 2022

(65) Prior Publication Data

US 2023/0151507 A1 May 18, 2023

(51) Int. Cl.
*C25D 17/06* (2006.01)
*C25D 17/00* (2006.01)
*C25D 21/12* (2006.01)

(52) U.S. Cl.
CPC ..... *C25D 17/06* (2013.01); *C25D 17/004* (2013.01); *C25D 21/12* (2013.01)

(58) Field of Classification Search
CPC ..... C25D 17/004; H01L 21/67376
See application file for complete search history.

(56) References Cited

FOREIGN PATENT DOCUMENTS

| | | | |
|---|---|---|---|
| JP | H06-069147 | A | 3/1994 |
| JP | 2003-214578 | A | 7/2003 |
| JP | 2006-214009 | A | 8/2006 |
| JP | 2006-249533 | A | 9/2006 |
| JP | 2008-019496 | A | 1/2008 |
| JP | 2020-057763 | A | 4/2020 |

*Primary Examiner* — Ciel P Contreras
(74) *Attorney, Agent, or Firm* — BakerHostetler

(57) ABSTRACT

Provided is a technique that ensures suppressed invasion of particles generated at a bearing of a rotation mechanism into a plating tank.

A plating apparatus 1000 includes a labyrinth seal member 50. The labyrinth seal member includes an inner labyrinth seal 53 arranged below a bearing 33 to seal the bearing, an outer labyrinth seal 54 arranged outside in a radial direction of the rotation shaft 32 with respect to the inner labyrinth seal, a delivery port 55 configured to supply air to an inner seal space 60 formed inside in the radial direction with respect to the inner labyrinth seal, and a suction port 56 configured to suction air in an outer seal space 65 formed outside in the radial direction with respect to the inner labyrinth seal and inside in the radial direction with respect to the outer labyrinth seal.

3 Claims, 5 Drawing Sheets

PLATING APPARATUS

TECHNICAL FIELD

The present invention relates to a plating apparatus.

BACKGROUND ART

Conventionally, there has been known what is called a cup type plating apparatus as a plating apparatus that can perform a plating process on a substrate (for example, see PTL 1). Such a plating apparatus includes a plating tank that accumulates a plating solution and includes an anode arranged therein, a substrate holder that is arranged above the anode and holds a substrate as a cathode, and a rotation mechanism that is arranged above the substrate holder and rotates the substrate holder. Further, such a rotation mechanism has a rotation shaft connected to the substrate holder and a bearing pivotally supporting this rotation shaft.

CITATION LIST

Patent Literature

PTL 1: Japanese Unexamined Patent Application Publication No. 2008-19496

SUMMARY OF INVENTION

Technical Problem

In the conventional plating apparatus as described above, in a case where particles, such as dirt, generated at the bearing of the rotation mechanism drop, the dropped particles possibly invade the plating tank.

The present invention has been made in view of the above, and one of the objects of the present invention is to provide a technique that ensures suppressed invasion of particles generated at a bearing of a rotation mechanism into a plating tank.

Solution to Problem

[Aspect 1] To achieve the above-described object, a plating apparatus according to one aspect of the present invention includes a plating tank, a substrate holder, a rotation mechanism, and a labyrinth seal member. The plating tank is configured to accumulate a plating solution and include an anode arranged inside the plating tank. The substrate holder is arranged above the anode and configured to hold a substrate as a cathode. The rotation mechanism is arranged above the substrate holder. The rotation mechanism includes a rotation shaft for connecting to the substrate holder and a bearing pivotally supporting the rotation shaft. The labyrinth seal member includes an inner labyrinth seal, an outer labyrinth seal, a delivery port, and a suction port. The inner labyrinth seal is arranged below the bearing to seal the bearing. The outer labyrinth seal is arranged outside in a radial direction of the rotation shaft with respect to the inner labyrinth seal. The delivery port is configured to supply air to an inner seal space formed inside in the radial direction with respect to the inner labyrinth seal. The suction port is configured to suction air in an outer seal space formed outside in the radial direction with respect to the inner labyrinth seal and inside in the radial direction with respect to the outer labyrinth seal.

With this aspect, even in a case where particles, such as dirt, generated at the bearing of the rotation mechanism drop into the inner seal space of the labyrinth seal member, together with the air supplied into the inner seal space, the particles can be made to pass through the inner labyrinth seal and be discharged into the outer seal space, and the particles discharged into the outer seal space can be suctioned from the suction port. This can suppress invasion of the particles generated at the bearing of the rotation mechanism into the plating tank.

[Aspect 2] In Aspect 1 described above, the labyrinth seal member further includes an upper plate and a lower plate arranged below the upper plate, the inner labyrinth seal and the outer labyrinth seal are arranged so as to be sandwiched between the upper plate and the lower plate, and the delivery port and the suction port are disposed in the upper plate.

[Aspect 3] In Aspect 2 described above, the rotation mechanism includes an outer cylindrical member arranged outside in the radial direction of the bearing, the outer cylindrical member is configured not to rotate even in a case where the rotation shaft rotates, and the upper plate is connected to a lower end of the outer cylindrical member, and the lower plate is connected to the rotation shaft.

With this aspect, since the outer cylindrical member does not rotate even when the rotation shaft rotates, the upper plate does not rotate either. Then, since the delivery port and the suction port are disposed in the upper plate that does not rotate, a structure of the labyrinth seal member can be simplified, compared with, for example, a case where the delivery port and the suction port are disposed in the lower plate.

[Aspect 4] In any one of Aspects 1 to 3 described above, the plating apparatus further includes a control module configured to perform control processing of supplying air from the delivery port and suctioning air from the suction port at least in a case where the rotation mechanism rotates the rotation shaft.

DESCRIPTION OF EMBODIMENTS

The following will describe an embodiment of the present invention with reference to the drawings. Note that, in the following embodiment, identical reference signs are assigned for identical or corresponding configurations, and their descriptions may be appropriately omitted. Further, the drawings are schematically illustrated to facilitate understanding of the features of objects, and dimensional proportions and the like of each constituent element are not necessarily the same as the actual ones. Further, in some drawings, orthogonal coordinates of X-Y-Z are illustrated for reference. Of the orthogonal coordinates, the Z direction corresponds to an upper side, and the −Z direction corresponds to a lower side (direction in which gravity acts).

Figure 1:
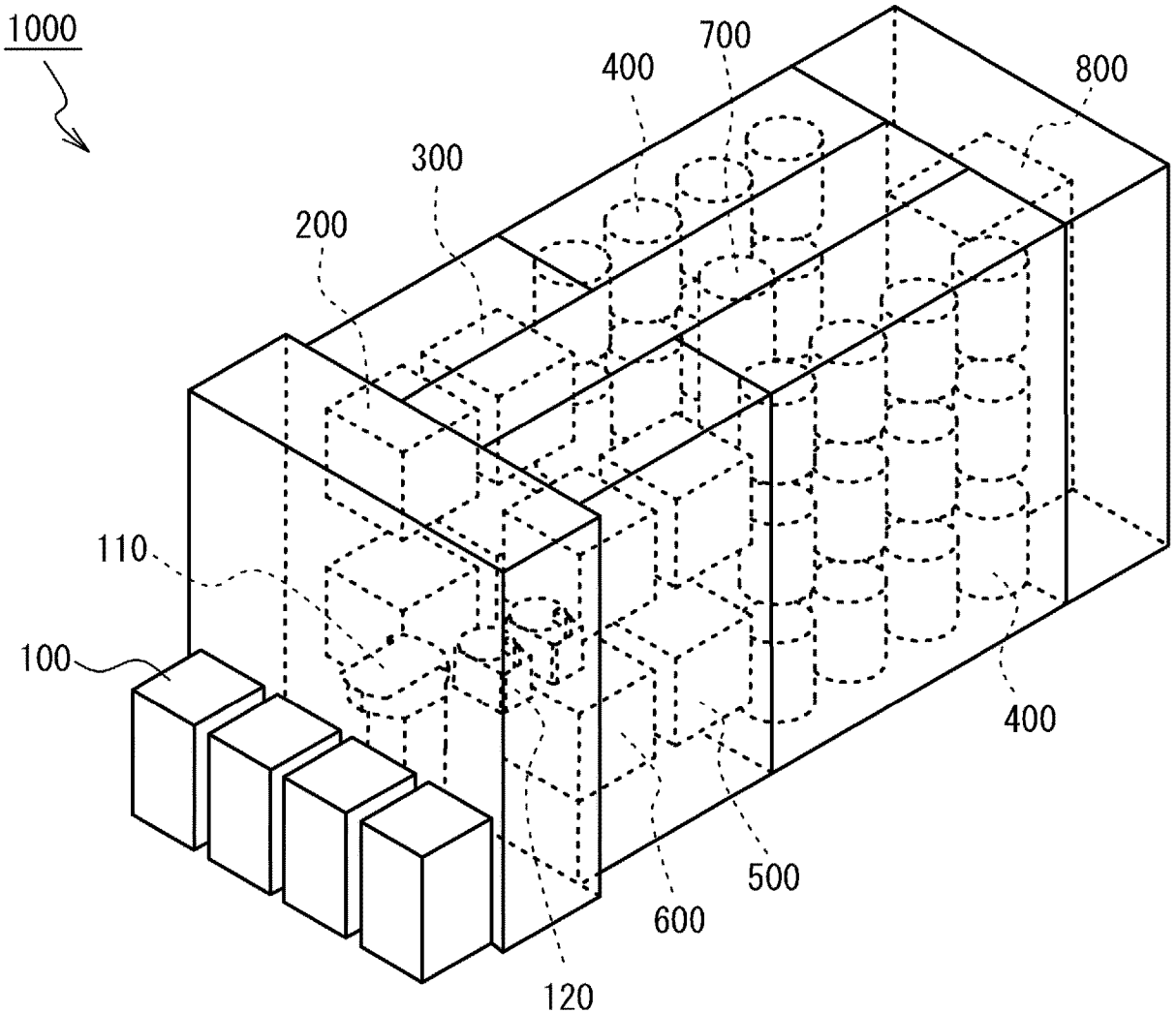
FIG. 1 is a perspective view illustrating an overall configuration of a plating apparatus of this embodiment.
Figure 2:
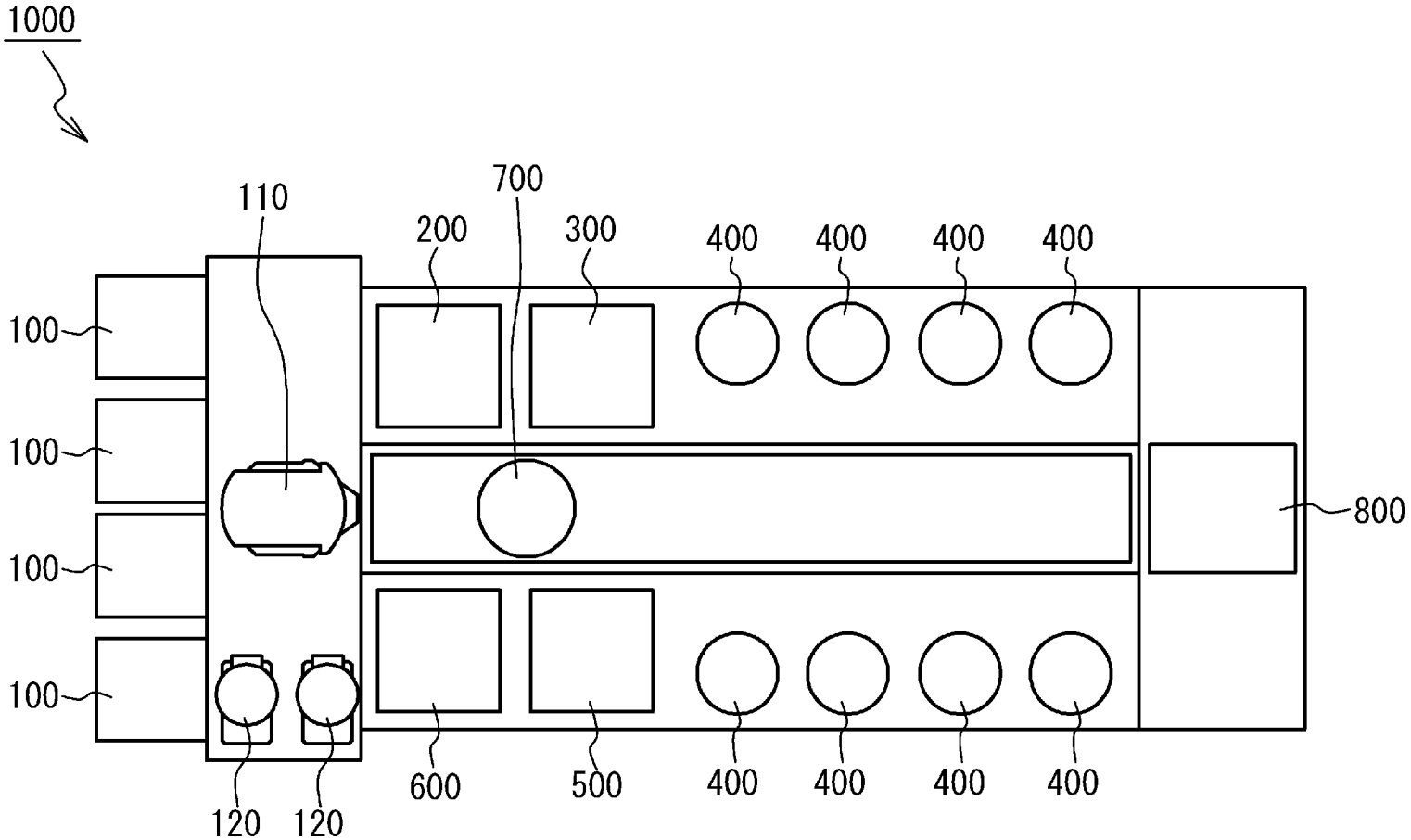
FIG. 2 is a plan view illustrating the overall configuration of the plating apparatus of this embodiment.

FIG. 1 is a perspective view illustrating the overall configuration of a plating apparatus 1000 of this embodiment. FIG. 2 is a plan view illustrating the overall configuration of the plating apparatus 1000 of this embodiment. As illustrated in FIGS. 1 and 2, the plating apparatus 1000 includes load ports 100, a transfer robot 110, aligners 120, pre-wet modules 200, pre-soak modules 300, plating modules 400, cleaning modules 500, spin rinse dryers 600, a transfer device 700, and a control module 800.

The load port 100 is a module for loading a substrate housed in a cassette, such as a FOUP, (not illustrated) to the plating apparatus 1000 and unloading the substrate from the plating apparatus 1000 to the cassette. While the four load ports 100 are arranged in the horizontal direction in this embodiment, the number of load ports 100 and arrangement of the load ports 100 are arbitrary. The transfer robot 110 is a robot for transferring the substrate that is configured to grip or release the substrate between the load port 100, the aligner 120, and the transfer device 700. The transfer robot 110 and the transfer device 700 can perform delivery and receipt of the substrate via a temporary placement table (not illustrated) to grip or release the substrate between the transfer robot 110 and the transfer device 700.

The aligner 120 is a module for adjusting a position of an orientation flat, a notch, and the like of the substrate in a predetermined direction. While the two aligners 120 are disposed to be arranged in the horizontal direction in this embodiment, the number of aligners 120 and arrangement of the aligners 120 are arbitrary. The pre-wet module 200 wets a surface to be plated of the substrate before a plating process with a process liquid, such as pure water or deaerated water, to replace air inside a pattern formed on the surface of the substrate with the process liquid. The pre-wet module 200 is configured to perform a pre-wet process to facilitate supplying the plating solution to the inside of the pattern by replacing the process liquid inside the pattern with a plating solution during plating. While the two pre-wet modules 200 are disposed to be arranged in the vertical direction in this embodiment, the number of pre-wet modules 200 and arrangement of the pre-wet modules 200 are arbitrary.

For example, the pre-soak module 300 is configured to remove an oxidized film having a large electrical resistance present on a surface of a seed layer formed on the surface to be plated of the substrate before the plating process by etching with a process liquid, such as sulfuric acid and hydrochloric acid, and perform a pre-soak process that cleans or activates a surface of a plating base layer. While the two pre-soak modules 300 are disposed to be arranged in the vertical direction in this embodiment, the number of pre-soak modules 300 and arrangement of the pre-soak modules 300 are arbitrary. The plating module 400 performs the plating process on the substrate. There are two sets of the 12 plating modules 400 arranged by three in the vertical direction and by four in the horizontal direction, and the total 24 plating modules 400 are disposed in this embodiment, but the number of plating modules 400 and arrangement of the plating modules 400 are arbitrary.

The cleaning module 500 is configured to perform a cleaning process on the substrate to remove the plating solution or the like left on the substrate after the plating process. While the two cleaning modules 500 are disposed to be arranged in the vertical direction in this embodiment, the number of cleaning modules 500 and arrangement of the cleaning modules 500 are arbitrary. The spin rinse dryer 600 is a module for rotating the substrate after the cleaning process at high speed and drying the substrate. While the two spin rinse dryers 600 are disposed to be arranged in the vertical direction in this embodiment, the number of spin rinse dryers 600 and arrangement of the spin rinse dryers 600 are arbitrary. The transfer device 700 is a device for transferring the substrate between the plurality of modules inside the plating apparatus 1000. The control module 800 is configured to control the plurality of modules in the plating apparatus 1000 and can be configured of, for example, a general computer including input/output interfaces with an operator or a dedicated computer.

An example of a sequence of the plating processes by the plating apparatus 1000 will be described. First, the substrate housed in the cassette is loaded on the load port 100. Subsequently, the transfer robot 110 grips the substrate from the cassette at the load port 100 and transfers the substrate to the aligners 120. The aligner 120 adjusts the position of the orientation flat, the notch, or the like of the substrate in the predetermined direction. The transfer robot 110 grips or releases the substrate whose direction is adjusted with the aligners 120 to the transfer device 700.

The transfer device 700 transfers the substrate received from the transfer robot 110 to the pre-wet module 200. The pre-wet module 200 performs the pre-wet process on the substrate. The transfer device 700 transfers the substrate on which the pre-wet process has been performed to the pre-soak module 300. The pre-soak module 300 performs the pre-soak process on the substrate. The transfer device 700 transfers the substrate on which the pre-soak process has been performed to the plating module 400. The plating module 400 performs the plating process on the substrate.

The transfer device 700 transfers the substrate on which the plating process has been performed to the cleaning module 500. The cleaning module 500 performs the cleaning process on the substrate. The transfer device 700 transfers the substrate on which the cleaning process has been performed to the spin rinse dryer 600. The spin rinse dryer 600 performs the drying process on the substrate. The transfer device 700 grips or releases the substrate on which the drying process has been performed to the transfer robot 110. The transfer robot 110 transfers the substrate received from the transfer device 700 to the cassette at the load port 100. Finally, the cassette housing the substrate is unloaded from the load port 100.

Note that the configuration of the plating apparatus 1000 described in FIG. 1 and FIG. 2 is merely an example, and the configuration of the plating apparatus 1000 is not limited to the configuration in FIG. 1 and FIG. 2.

Subsequently, the plating modules 400 will be described. Since the plurality of plating modules 400 included in the plating apparatus 1000 according to this embodiment have the identical configuration, one of the plating modules 400 will be described.

Figure 3:
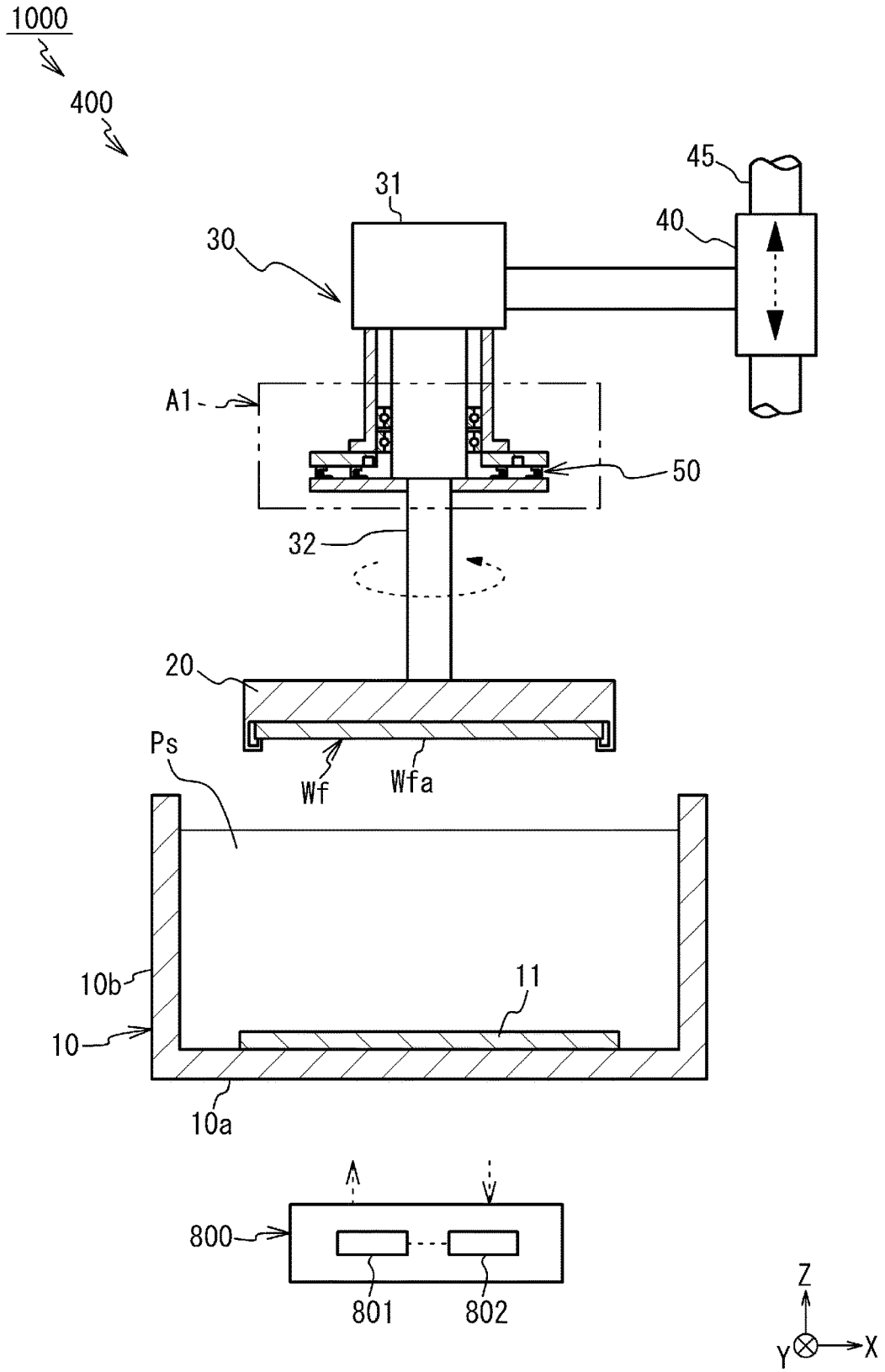
FIG. 3 is a schematic diagram for describing a configuration of a plating module in the plating apparatus of this embodiment.

FIG. 3 is a schematic diagram for describing the configuration of the plating module 400 according to this embodiment. The plating apparatus 1000 according to this embodiment is a cup type plating apparatus. The plating module 400 mainly includes a plating tank 10, a substrate holder 20, a rotation mechanism 30, an elevating mechanism 40, and a labyrinth seal member 50. Note that, in FIG. 3, cross sections of the plating tank 10, the substrate holder 20, and the rotation mechanism 30 are schematically illustrated.

The plating tank 10 according to this embodiment is configured of a container with a bottom having an opening on an upper side. Specifically, the plating tank 10 has a bottom portion 10*a* and an outer peripheral portion 10*b* extending upward from an outer peripheral edge of the bottom portion 10*a*, and an upper portion of the outer peripheral portion 10*b* is open. Note that, although the shape of the outer peripheral portion 10*b* of the plating tank 10 is not particularly limited, the outer peripheral portion 10*b* according to this embodiment has a cylindrical shape as an example.

In an inside of the plating tank 10, a plating solution Ps is accumulated. It is only necessary for the plating solution Ps to be a solution including an ion of a metallic element constituting a plating film, and a specific example of the plating solution Ps is not particularly limited. In this embodiment, a copper plating process is used as an example of the plating process, and a copper sulfate solution is used as an example of the plating solution Ps. Further, in this embodiment, a predetermined additive is included in the plating solution Ps. However, the configuration of the plating solution Ps is not limited to this, and the plating solution Ps can be configured not to include an additive.

In the inside of the plating solution Ps in the plating tank 10, an anode 11 is arranged. The specific type of the anode 11 is not particularly limited, and a soluble anode or an insoluble anode can be used. In this embodiment, the insoluble anode is used as the anode 11. The specific type of the insoluble anode is not particularly limited, and platinum, iridium oxide, and the like can be used.

The substrate holder 20 is a member for holding a substrate Wf as a cathode. Note that, a lower surface Wfa of the substrate Wf corresponds to a surface to be plated. The substrate holder 20 is connected to a rotation shaft 32 of the rotation mechanism 30.

The rotation mechanism 30 is arranged above the substrate holder 20. The rotation mechanism 30 is a mechanism for rotating the substrate holder 20. Details of the rotation mechanism 30 will be described below.

The elevating mechanism 40 is supported by a spindle 45 extending in a vertical direction. The elevating mechanism 40 is a mechanism for moving up and down the substrate holder 20 and the rotation mechanism 30 in the vertical direction. As the elevating mechanism 40, a known elevating mechanism, such as a linear motion type actuator, can be used.

When the plating process is performed, the rotation mechanism 30 rotates the substrate holder 20 while the elevating mechanism 40 moves the substrate holder 20 downward to immerse the substrate Wf in the plating solution Ps in the plating tank 10. After the substrate Wf is immersed in the plating solution Ps, a current flows between the anode 11 and the substrate Wf by an energization device (not illustrated). This forms the plating film on the lower surface Wfa of the substrate Wf.

The operation of the plating module 400 is controlled by the control module 800. The control module 800 includes a microcomputer, and the microcomputer includes a CPU (Central Processing Unit) 801 as a processor, a storage device 802 as a non-transitory storage medium, and the like. The control module 800 controls devices to be controlled of the plating module 400 by an operation of the CPU 801 based on a command of a program stored in the storage device 802. Further, the control module 800 according to this embodiment also controls an air supply device 70 described later.

Figure 4:
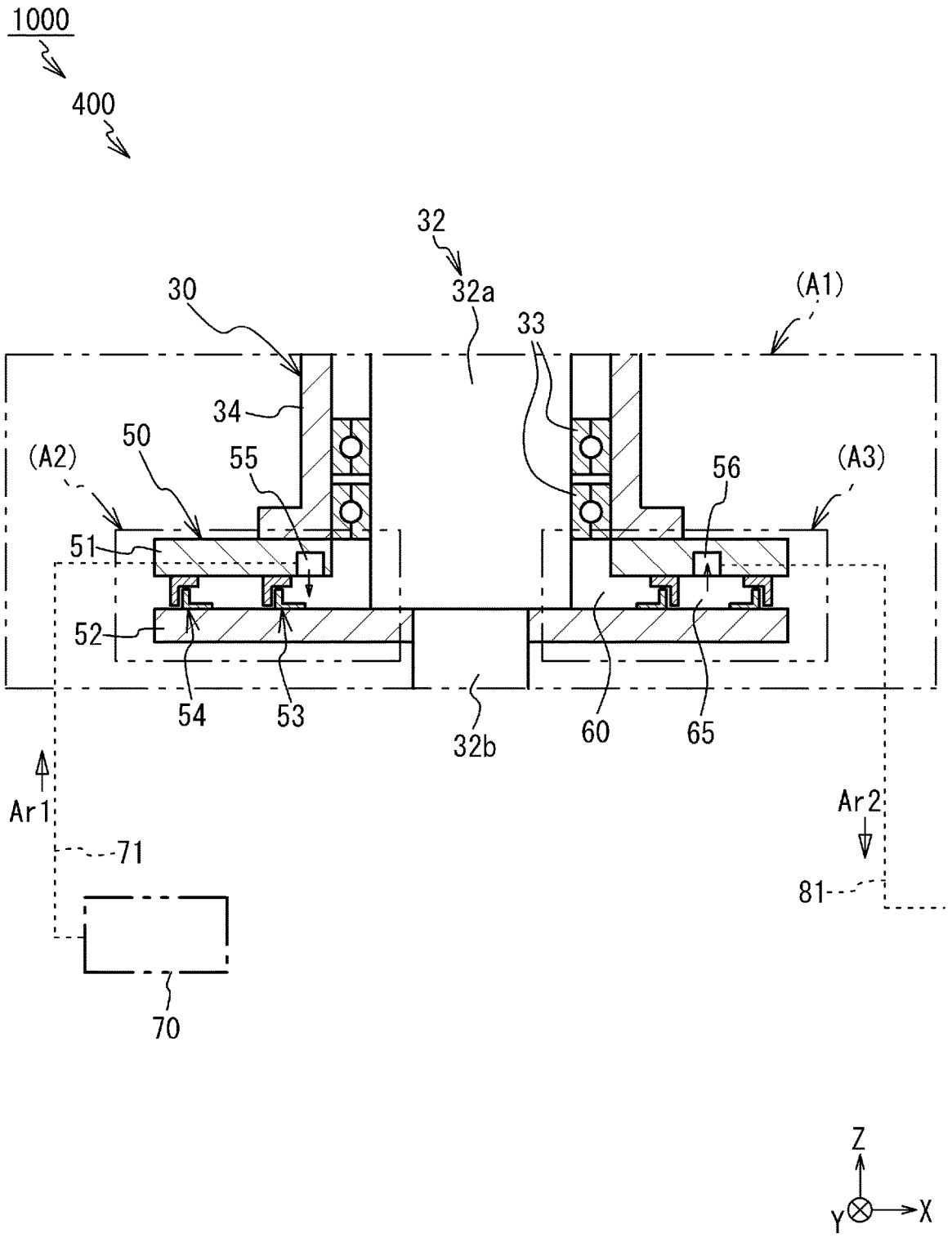
FIG. 4 is a schematic diagram for describing a configuration of a rotation mechanism and a labyrinth seal member of this embodiment.

FIG. 4 is a schematic diagram for describing a configuration of the rotation mechanism 30 and the labyrinth seal member 50. Specifically, FIG. 4 illustrates an enlarged cross section of an A1 part of FIG. 3. With reference to FIG. 3 and FIG. 4, the rotation mechanism 30 includes a rotation drive device 31, the rotation shaft 32, bearings 33, and an outer cylindrical member 34.

As illustrated in FIG. 3, the rotation shaft 32 has an upper end connected to the rotation drive device 31, and the rotation shaft 32 has a lower end connected to the substrate holder 20. The rotation drive device 31 is configured of a known rotation drive device, such as a motor. The rotation drive device 31 rotates the rotation shaft 32, and thus the substrate holder 20 connected to the rotation shaft 32 rotates.

With reference to FIG. 4, although the specific configuration of the rotation shaft 32 is not particularly limited, the rotation shaft 32 according to this embodiment includes a large-diameter portion 32*a* having a relatively large diameter and a small-diameter portion 32*b* having a relatively small diameter, as an example. The small-diameter portion 32*b* is connected to a lower end of the large-diameter portion 32*a*.

The bearings 33 are members for pivotally supporting the rotation shaft 32. The bearings 33 according to this embodiment are arranged outside in a radial direction of the large-diameter portion 32*a* of the rotation shaft 32. The outer cylindrical member 34 is arranged outside in a radial direction of the bearings 33 (radial direction of the rotation shaft 32). That is, the bearings 33 according to this embodiment are sandwiched between the rotation shaft 32 and the outer cylindrical member 34.

The number of the bearings 33 according to this embodiment is plural as an example. Specifically, the rotation mechanism 30 has the bearing 33 arranged on an upper stage side and the bearing 33 arranged on a lower stage side. However, the number of the bearings 33 is not limited to this, and the number of the bearings 33 may be more than two pieces or may be one piece. Although the type of the bearing 33 is not particularly limited, a bearing (rolling bearing) is used as an example in this embodiment.

Figure 5A:
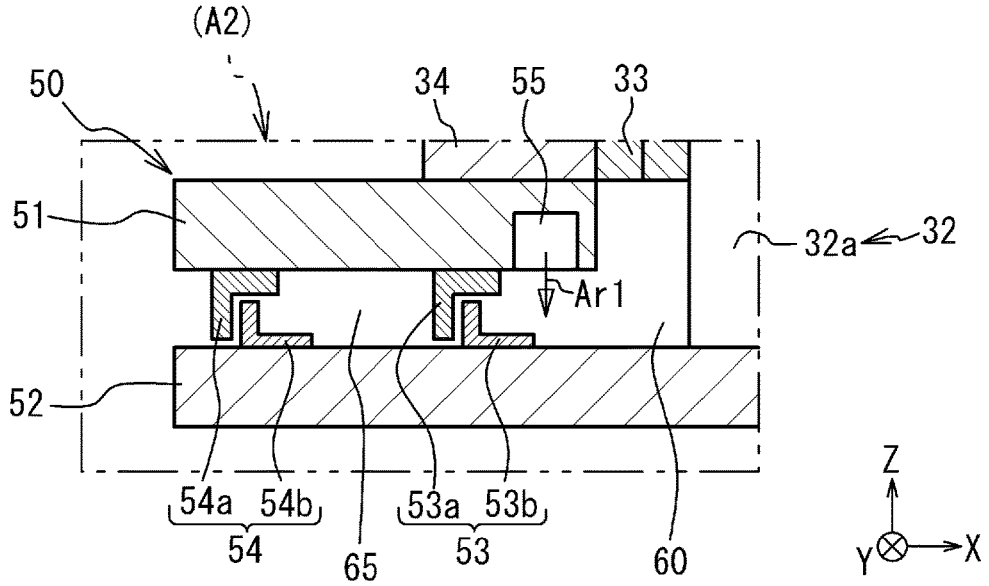
FIG. 5A is an enlarged cross-sectional view of an A2 part of FIG. 4.
Figure 5B:
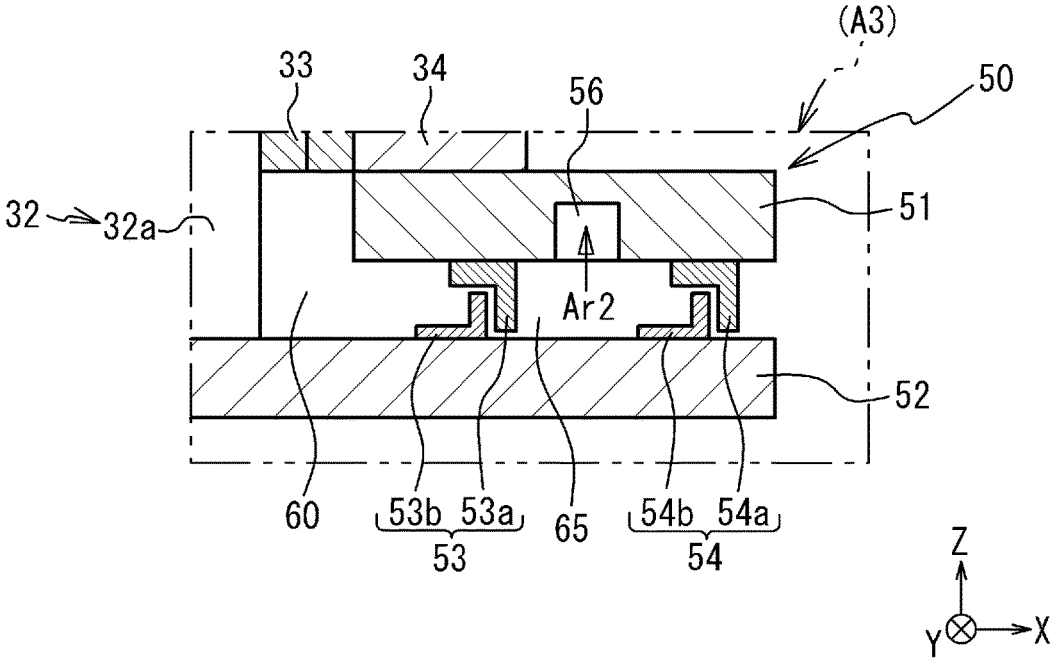
FIG. 5B is an enlarged cross-sectional view of an A3 part of FIG. 4.

FIG. 5A is an enlarged cross-sectional view of an A2 part of FIG. 4, and FIG. 5B is an enlarged cross-sectional view of an A3 part of FIG. 4. With reference to FIG. 4, FIG. 5A and FIG. 5B, the labyrinth seal member 50 includes an upper plate 51, a lower plate 52, an inner labyrinth seal 53, and an outer labyrinth seal 54.

The upper plate 51 is connected to a lower end of the outer cylindrical member 34, Since the outer cylindrical member 34 does not rotate in a case where the rotation shaft 32 rotates, the upper plate 51 connected, to the outer cylindrical member 34 does not rotate either. The lower plate 52 is arranged below the upper plate 51 and connected to the small-diameter portion 32*b* of the rotation shaft 32. In a case where the rotation shaft 32 rotates, the lower plate 52 rotates together with the rotation shaft 32. The inner labyrinth seal 53 and the outer labyrinth seal 54 are arranged so as to be sandwiched between the upper plate 51 and the lower plate 52.

The inner labyrinth seal 53 is arranged below the bearings 33 of the rotation mechanism 30 and disposed for sealing the bearings 33. As illustrated in FIG. 5A and FIG. 5B, the inner labyrinth seal 53 according to this embodiment includes an upper side seal member 53*a* connected to a lower surface of the upper plate 51 and a lower side seal member 53*b* connected to an upper surface of the lower plate 52. By the upper side seal member 53*a* and the lower side seal member 53*b*, a labyrinth seal structure is formed, in a region inside in the radial direction with respect to the inner labyrinth seal 53, an inner seal space 60 is formed.

The outer labyrinth seal 54 is arranged outside in the radial direction with respect to the inner labyrinth seal 53.

Specifically, the outer labyrinth seal 54 includes an upper side seal member 54*a* connected to the lower surface of the upper plate 51 and a lower side seal member 54*b* connected to the upper surface of the lower plate 52. By the upper side seal member 54*a* and the lower side seal member 54*b*, a labyrinth seal structure is formed. With this, in a region outside in the radial direction with respect to the inner labyrinth seal 53 and inside in the radial direction with respect to the outer labyrinth seal 54, an outer seal space 65 is formed.

Further, the labyrinth seal member 50 includes a delivery port 55 configured to supply air (Ar1) to the inner seal space 60 and a suction port 56 configured to suction air (Ar2) in the outer seal space 65. Specifically, the delivery port 55 and the suction port 56 according to this embodiment are disposed in the upper plate 51.

With this configuration, since the delivery port 55 and the suction port 56 are disposed in the upper plate 51 that does not rotate, a structure of the labyrinth seal member 50 can be simplified, compared with, for example, a case where the delivery port 55 and the suction port 56 are disposed in the lower plate 52 (which rotates together with the rotation shaft 32).

Note that, while one piece each of the delivery port 55 and the suction port 56 are disposed in this embodiment, the numbers of the delivery port 55 and the suction port 56 are not limited to this. To give another example, the number of the delivery port 55 may be plural. Similarly, the number of the suction port 56 may also be plural.

With reference to FIG. 4, the delivery port 55 is communicated with the air supply device 70 via a supply flow passage 71. The air supply device 70 is a device for supplying the air (Ar1) to the delivery port 55. The air (Ar1) supplied from the air supply device 70 flows through the supply flow passage 71, and then, the air (Ar1) is delivered out from the delivery port 55 and flows into the inner seal space 60. Note that, in this embodiment, the air supply device 70 is not a part of the constituent elements of the plating apparatus 1000. Specifically, in this embodiment, as the air supply device 70, an air supply device included in plant equipment in which the plating apparatus 1000 is installed (that is, an existing air supply device in the plant equipment) is used.

The air (Ar1) that has flowed into the inner seal space 60 can leak from a gap (minute gap) between the upper side seal member 53*a* and the lower side seal member 53*b* of the inner labyrinth seal 53 and flow into the outer seal space 65.

Note that, in this embodiment, as an example of the air (Ar1) supplied from the air supply device 70 to the delivery port 55, clean air that does not include particles having a particle size of 0.1 μm or more is used.

The suction port 56 is communicated with an exhaust air flow passage 81. In this embodiment, an upstream-side end portion in an air flow direction of the exhaust air flow passage 81 is communicated with the suction port 56, and a downstream-side end portion of the exhaust air flow passage 81 is arranged at a predetermined position in an outside of the plating tank 10. This allows the air (Ar2) suctioned from the suction port 56 to pass through the exhaust air flow passage 81 and to be discharged to the predetermined position in the outside of the plating tank 10. Note that this predetermined position is preferably a position other than an upper side of the plating solution Ps in the plating tank 10. This is because, with this configuration, even in a case where the particles contained in the air that has passed through the exhaust air flow passage 81 drop, the invasion of the particles in the inside of the plating solution Ps in the plating tank 10 can be surely suppressed. Further, similarly to this embodiment, as long as the air is supplied from the air supply device 70 to the delivery port 55 even when an air exhausting device, such as an exhaust air pump, is not arranged in the exhaust air flow passage 81, the air in the outer seal space 65 can be suctioned from the suction port 56 by utilizing a pressure difference between the outer seal space 65 and atmospheric air.

Further, the control module 800 according to this embodiment is configured to perform control processing of supplying the air to the delivery port 55 and suctioning the air from the suction port 56 at least in a case where the rotation mechanism 30 rotates the rotation shaft 32 (that is, in a case where the substrate holder 20 rotates).

Specifically, at least in a case where rotation of the rotation shaft 32 of the rotation mechanism 30 starts, the control module 800 according to this embodiment starts an air supply from the air supply device 70. At least while the rotation of the rotation shaft 32 is being performed, the control module 800 continues the air supply from the air supply device 70. With this, at least while the rotation shaft 32 of the rotation mechanism 30 is rotating, the air supply to the delivery port 55 is performed and an air suction from the suction port 56 is performed.

With this embodiment as described above, even in a case where the particles, such as dirt, generated at the bearings 33 of the rotation mechanism 30 drop into the inner seal space 60 of the labyrinth seal member 50, together with the air supplied into the inner seal space 60, the particles can be made to pass through the inner labyrinth seal 53 (made to pass through the minute gap of the inner labyrinth seal 53) and be discharged into the outer seal space 65, and the particles discharged into the outer seal space 65 can be suctioned from the suction port 56. This can suppress the invasion of the particles generated at the bearings 33 of the rotation mechanism 30 into the plating tank 10.

Further, with this embodiment, an internal pressure of the inner seal space 60 can be made higher than an atmospheric pressure by supplying the air from the delivery port 55 to the inner seal space 60. This can effectively suppress invasion of acidic vapor generated from the plating solution Ps in the plating tank 10 into the inner seal space 60. As a result, corroding the hearings 33 of the rotation mechanism 30 by the acidic vapor can be effectively suppressed.

Although the embodiment of the present invention has been described in detail above, the present invention is not limited to such specific embodiment, and further various kinds of variants and modifications are possible within the scope of the gist of the present invention described in the claims.

For example, the labyrinth seal member 50 is not limited to that exemplified in FIG. 4. To give another example, for example, the plating apparatus 1000 may include a plurality of labyrinth seal members 50 as exemplified in FIG. 4. Specifically, in this case, the plurality of labyrinth seal members 50 may be arranged on a plurality of stages in an axial direction (in the vertical direction) of the rotation shaft 32.

REFERENCE SIGNS LIST

10 . . . plating tank
11 . . . anode
20 . . . substrate holder
30 . . . rotation mechanism
32 . . . rotation shaft
33 . . . bearing

34 . . . outer cylindrical member
50 . . . labyrinth seal member
51 . . . upper plate
52 . . . lower plate
53 . . . inner labyrinth seal
54 . . . outer labyrinth seal
55 . . . delivery port
56 . . . suction port
60 . . . inner seal space
65 . . . outer seal space
70 . . . air supply device
400 . . . plating module
1000 . . . plating apparatus
Wf . . . substrate
Wfa . . . lower surface
Ps . . . plating solution
Ar1, Ar2 . . . air

The invention claimed is:

1. A plating apparatus comprising:

a plating tank configured to accumulate a plating solution and include an anode arranged inside the plating tank;

a substrate holder arranged above the anode and configured to hold a substrate as a cathode;

a rotation mechanism arranged above the substrate holder, the rotation mechanism including a rotation shaft for connecting to the substrate holder and a bearing pivotally supporting the rotation shaft;

a labyrinth seal member that includes:

an inner labyrinth seal arranged below the bearing to seal the bearing;

an outer labyrinth seal arranged outside in a radial direction of the rotation shaft with respect to the inner labyrinth seal;

a delivery port configured to supply air to an inner seal space formed inside in the radial direction with respect to the inner labyrinth seal; and a suction port configured to suction air in an outer seal space formed outside in the radial direction with respect to the inner labyrinth seal and inside in the radial direction with respect to the outer labyrinth seal; and a control module configured to perform control processing of supplying air from the delivery port and suctioning air from the suction port at least in a case where the rotation mechanism rotates the rotation shaft.

2. The plating apparatus according to claim 1, wherein the labyrinth seal member further includes an upper plate and a lower plate arranged below the upper plate, the inner labyrinth seal and the outer labyrinth seal are arranged so as to be sandwiched between the upper plate and the lower plate, and the delivery port and the suction port are disposed in the upper plate.

3. The plating apparatus according to claim 2, wherein the rotation mechanism includes an outer cylindrical member arranged outside in the radial direction of the bearing, the outer cylindrical member is configured not to rotate even in a case where the rotation shaft rotates, and the upper plate is connected to a lower end of the outer cylindrical member, and the lower plate is connected to the rotation shaft.

* * * * *